US006278664B1

(12) United States Patent
Huffman et al.

(10) Patent No.: US 6,278,664 B1
(45) Date of Patent: Aug. 21, 2001

(54) TIMEPIECE WITH INTERCHANGEABLE DISPLAYS

(76) Inventors: Ann C. Huffman; Gary Huffman, both of 2002 S. 20th St., St. Joseph, MO (US) 64507

( * ) Notice: Subject to any disclaimer, the term of this patent is extended or adjusted under 35 U.S.C. 154(b) by 0 days.

(21) Appl. No.: 09/305,122

(22) Filed: May 4, 1999

(51) Int. Cl.[7] ..... G04B 19/00; G04B 19/06; G04B 37/00

(52) U.S. Cl. ..... 368/223; 368/236; 368/276

(58) Field of Search ..... 368/76, 80, 88, 368/222, 223, 228, 232, 276, 297, 299, 300, 314, 322–323

(56) References Cited

U.S. PATENT DOCUMENTS

| | | | |
|---|---|---|---|
| 898,405 | | 9/1908 | Fitzsimmons . |
| 1,517,174 | | 11/1924 | Schmidt . |
| 2,605,604 | | 8/1952 | Lavigna . |
| 2,635,357 | | 4/1953 | Whitlock . |
| 3,014,298 | | 12/1961 | Kirshner . |
| 3,132,469 | * | 5/1964 | Bille et al. . |
| 3,889,806 | | 6/1975 | Casella . |
| 4,006,586 | | 2/1977 | Casella . |
| 4,112,672 | | 9/1978 | Ginefra, Sr. . |
| 4,222,227 | | 9/1980 | Arabian . |
| 4,253,178 | | 2/1981 | Kolaczia . |
| 4,332,020 | | 5/1982 | Leopold . |
| 4,473,304 | | 9/1984 | Ketner . |
| 4,493,561 | | 1/1985 | Bouchet . |
| 4,494,880 | | 1/1985 | Su . |
| 4,525,077 | | 6/1985 | Ketner . |
| 4,624,579 | | 11/1986 | Forman . |
| 4,660,992 | | 4/1987 | Paul et al. . |
| 4,684,264 | | 8/1987 | Paperno et al. . |
| 4,720,820 | | 1/1988 | Siefert . |
| 4,939,913 | | 7/1990 | Scungio et al. . |
| 5,018,118 | | 5/1991 | Ross . |
| 5,043,955 | | 8/1991 | Dubois et al. . |
| 5,077,709 | | 12/1991 | Feber . |
| 5,142,512 | | 8/1992 | Takano et al. . |
| 5,168,479 | | 12/1992 | Lima . |
| 5,216,642 | | 6/1993 | Rikkers . |
| 5,224,078 | | 6/1993 | Mallin . |
| 5,319,615 | | 6/1994 | Ng . |
| 5,375,102 | | 12/1994 | Schiavolini . |
| 5,380,206 | | 1/1995 | Asprey . |
| 5,396,474 | | 3/1995 | Lin . |
| 5,646,913 | | 7/1997 | Quesenberry . |
| 5,787,055 | * | 8/1998 | Jacobi ..... 368/223 |
| 6,118,735 | * | 9/2000 | Li ..... 368/228 |

* cited by examiner

*Primary Examiner*—Vit Miska
(74) *Attorney, Agent, or Firm*—Shughart Thomson & Kilroy P.C.; Mark E. Brown

(57) ABSTRACT

A timepiece includes interchangeable faces. The timepiece comprises a supportive structure, a face subassembly, and a clock mechanism. The face subassembly includes a backing with a front or outer surface and an inner surface, and a display with an inner surface and an outer surface. Markings may appear on the backing's outer surface or on the display. The display's outer surface can be decorated. First and second openings extend through the backing. An opening also extends through the display. One or more seats are attached near corners of the backing's outer surface. One or more connectors are attached near corners of the display's inner surface. The clock mechanism includes a clock motor with a shaft mounted on the backing's rear surface with the shaft extending through the backing's first opening. One or more hands are attached to an end of the shaft. The display can be removably attached to the backing by positioning thereon and is held in place by the coupling force between the backing's seats and the display's connectors. The display can be removed by inserting one's finger through one of the backing's openings and pushing the display away from the backing.

2 Claims, 4 Drawing Sheets

TIMEPIECE WITH INTERCHANGEABLE DISPLAYS

BACKGROUND OF THE INVENTION

1. Field of the Invention

The present invention relates generally to timepieces, and in particular to a timepiece with a decorative, changeable display.

2. Description of the Related Art

Decorative timepieces are not new. Numerous timepieces have been developed with ornamental displays, casings and other parts. However, unlike the present invention, many timepieces' ornamental appearances cannot be readily altered after manufacture and assembly.

The prior art includes the Takano et al. U.S. Pat. No. 5,142,512. Although this invention discloses a clock with a separate decorative cover sheet, the cover sheet is not readily removable.

The prior art also includes the Schiavolini U.S. Pat. No. 5,375,102, which discloses a clock having an interchangeable decorative member. However, unlike the present invention, the decorative member shown in the '102 patent is attached to a removable frame which in turn is attached to the clock. The partially transparent member and frame are placed over or above the clock's hands.

Others have designed different decorative timepieces. However, such timepieces generally are more complicated in construction and, therefore, more expensive to manufacture and more difficult to use. The present invention addresses the shortcomings of the previous decorative timepieces. Heretofore there has not been available a timepiece with an interchangeable display with the advantages and features of the present invention.

SUMMARY OF THE INVENTION

The present invention generally comprises a timepiece including a supportive structure, a face subassembly and a clock mechanism. In the present embodiment, the supportive structure is a cabinet subassembly including a pair of sides, a top, and a bottom which form an enclosure. A backing is positioned in the enclosure and mounted to the supportive structure. The backing includes a front or outer surface and a rear or inner surface. A first opening extends through the backing, and a second opening or finger hole also extends through the backing. A plurality of seats are attached near respective corners of the backing's outer surface. In the primary embodiment, markings (e.g. numerals or other markings) appear on the backing's outer surface. In a modified embodiment, markings appear on a display, as discussed below. A compartment is formed in the rear of the enclosure.

The face subassembly includes a decorative display which can be mounted to and removed from the backing to provide different ornamentation. Different displays promote versatility and a sense of newness as the timepiece takes on entirely different looks. The display can be changed, for example, with the seasons, to announce holidays, or to "grow" with a child. The display includes a front or outer surface, and an inner surface. The display can be painted, drawn upon, covered in fabric or otherwise decorated. Markings may appear on the display. The display and supportive structure can assume various shapes including, for example, rectangular, circular, triangular, or an oval.

The display can be of a shape to cover the entire backing or a portion thereof. A circular opening extends through the the display. Connectors are attached to the display's inner surface.

The display can be removably attached to backing's outer surface by positioning thereon. A coupling force is created between the backing's seats and the display's connectors, holding the display in place.

The display can be removed by inserting one's finger from the backing's rear surface through the finger hole and pushing with sufficient force to break the couple between the seats and the connectors. Additional displays may then be positioned on the backing.

The clock mechanism includes a motor mounted on the backing's rear surface with a shaft extending therefrom through the backing's first opening. The shaft will also extend through the display's opening when it is positioned on the backing. Hands are mounted on an end of the shaft. A power source supplies power to the motor.

OBJECTS AND ADVANTAGES OF THE INVENTION

The principle objects and advantages of the present invention include: providing a timepiece with an ornamental display that can be readily changed; providing such a timepiece that is versatile for different decorative needs; providing such a display that can be covered in fabric, painted, drawn upon or otherwise decorated; providing such a display that can be easily removed without the need for any special tools; providing such a timepiece which also serves as a storage compartment for additional displays; providing such a timepiece which is relatively simple to manufacture; providing such a timepiece that keeps accurate time; and providing such a device which is particularly well adapted for the intended usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
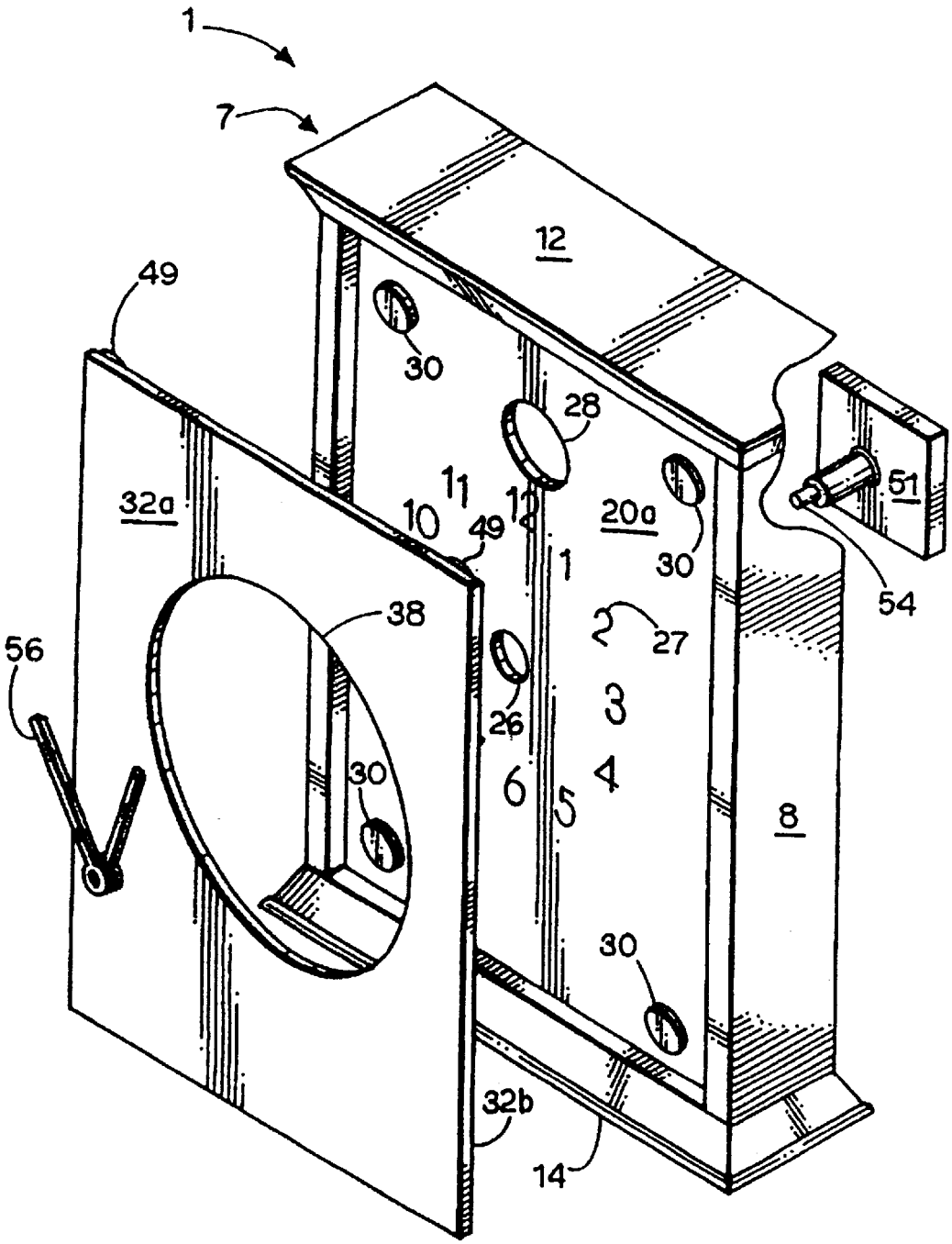
FIG. 1 is an exploded, perspective view of a timepiece embodying the present invention.
Figure 2:
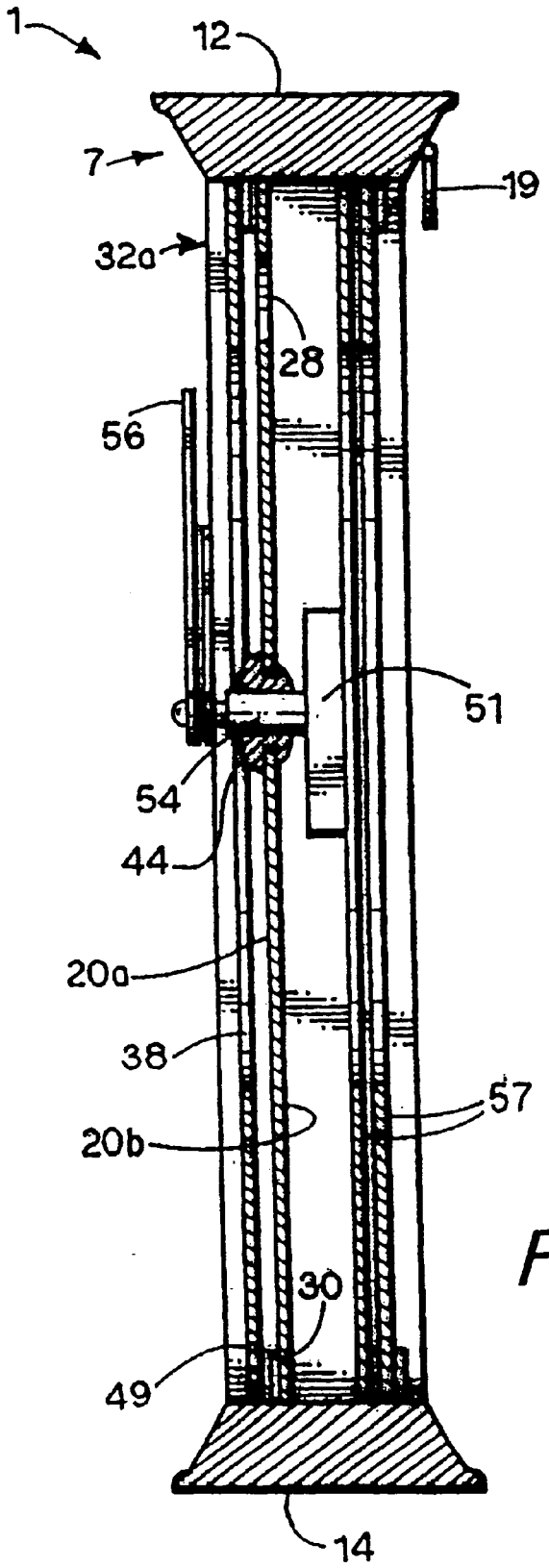
FIG. 2 is a vertical, cross-sectional view of the timepiece.

I. Introduction and Environment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, The words "upwardly", "downwardly", "rightwardly", and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in greater detail, the reference numeral 1 generally refers to a timepiece embodying the present invention. The timepiece 1 may, for example, be of the wall mounted or desktop variety, or a watch, an alarm clock, or other timepiece. The timepiece 1 generally comprises a supportive structure 2, a face subassembly 4 and a clock mechanism 6.

II. Supportive Structure 2.

The supportive structure 2 is shown in FIG. 1 as a generally rectangularly-shaped cabinet subassembly 7, but includes other structural shapes (e.g. multi-sided frames, ovals, circles, triangles, polygons, etc.). The cabinet subassembly 7 may be constructed of any suitable material (e.g. wood, plastic, cardboard, glass, ceramic, polymer etc.) by joining (e.g. gluing, connecting with fasteners, etc.) the various components. The cabinet subassembly 7 comprises a pair of sides 8 and 10 joined at upper edges thereof by a top 12, and at lower edges thereof by a bottom 14 to form an enclosure 16. A compartment 18, the function of which will be discussed later, is formed in a rear portion of the enclosure 16. A keeper or tab 19, which also will be discussed later, is mounted by any suitable means (e.g. a screw) to a rear edge of the top 12.

III. Face Subassembly 4.

The face subassembly 4 includes a stiff backing plate or panel 20 positioned within the enclosure 16 of the cabinet subassembly 2 and secured thereto by any suitable means (e.g. an adhesive, tongue and groove connectors, nails, etc.). The backing 20 includes a front or outer surface 20*a* and an inner surface 20*b*. A first circular opening 26 extends through the backing 20. Clock-face markings 27 (e.g Arabic or Roman numerals, symbols, etc.) may be made on the backing's outer surface 20*a* surrounding the opening 26. A second circular opening or finger hole 28, the purpose of which will be discussed later, also extends through the backing 20. A plurality of seats 30 (e.g., washers, magnets, hook and loop type fasteners, etc.), the purpose of which will be discussed later, are attached by any suitable means (e.g., glue) to the backing's outer surface 20*a*. In the present embodiment, the seats 30 are attached near corners of the backing's outer surface 20*a*.

The face subassembly 4 also includes a display 32 (e.g., a cover, an etching, a photograph, a painting, or other display). The display 32 can be of any size and shape that can be positioned on top of or covering the backing's outer surface 20*a* or a portion thereof. The display 32 includes an outer surface 32*a* and an inner surface 32*b*. A circular opening 38 may extend through the display 32.

Figure 3:
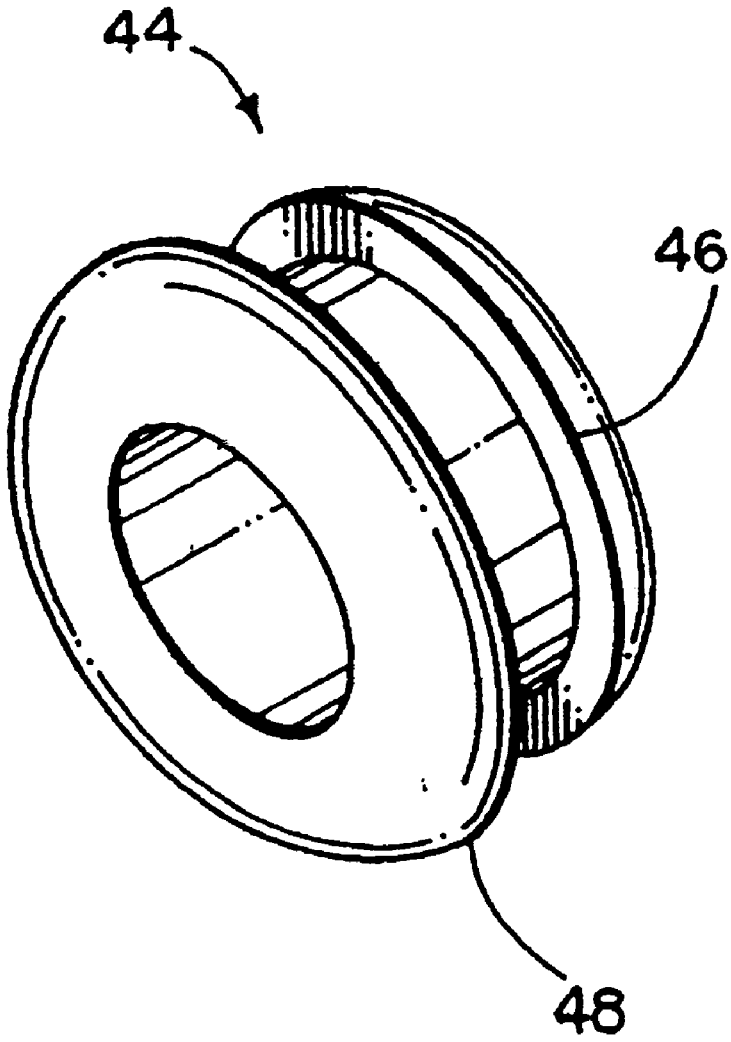
FIG. 3 is a perspective view of a centerpiece of the timepiece.

It is also foreseen that an outer layer of cloth or fabric 40 (not shown) may be attached to the display 32 by cutting a length thereof sufficient to cover the display's outer surface 32*a* and attaching (e.g. gluing) it thereto. A circular opening 42 is cut in the center of the fabric 40 concentric with the display's opening 38. After the fabric 40 is attached to the display 32, a generally cylindrical centerpiece 44 (see FIG. 3) is inserted into the opening 38. The centerpiece 44 has an inner lip 46 and a larger outer lip 48, and is held in place by a friction fit with the display's opening 38 when inserted therein. The centerpiece 44 protects the edges of the display's opening 38 and prevents fraying or unweaving of the fabric 40 at the opening 42. The centerpiece 44 may be constructed from a variety of materials including rubber, plastic wood, metal, etc.

A plurality of connectors 49 (e.g. washers, magnets, Velcro, fasteners, etc.), are attached by any suitable means (e.g. glue) to the display's inner surface 32*b*. In the present embodiment, the connectors 49 are attached near corners of the display's inner surface 32*b*. The connectors 49 are positioned on the display 32 to be in alignment and coupled with the seats 30 of the backing 20 when the display 32 is positioned thereon. A plurality of ornamental trim pieces 50 (not shown) may be removably attached by any suitable means (e.g. magnets or friction fitting) to edges of the display 32.

IV. Clock Mechanism 6.

The clock mechanism 6 includes a powered motor 51 mounted to the backing's rear surface 20*b*. The motor 51 may be powered by any suitable source (e.g., alternating current, direct current, solar, etc.). The motor 51 mounts a shaft 54 extending therefrom and through the first backing opening 26. A plurality of hands 56 (e.g., hour and minute) are mounted to an end of the shaft by any suitable means (e.g., a friction fit).

V. Timepiece 1 Assembly/Changing the Display 4.

Assembly of the timepiece 1 is as follows. The display 32 is positioned on top of or covering the backing's outer surface 20*a* and is removably attached thereto by the coupling force between the backing's seats 30 and the display's connectors 46. In this position, a portion of the shaft 54 with the hands 56 attached thereto extends through the first backing opening 26. Therefore, a person in front of the display 32 can "read" the clock by observing the hands 56 in relation to the markings 27, which are visible on the backing 20 through the opening 26 in the display 32. The display 32 can be easily removed or changed by inserting a person's finger from the rear through the finger hole 28 and pushing on the display 32 with sufficient force to break the coupling between the seats 30 and the connectors 40. This simple procedure allows different displays 32 to be attached to the cabinet subassembly 7 as described above. For convenience, additional or spare displays 57 may be kept within the compartment 18 and held therein by the keeper 19.

VI. First Modified Embodiment Timepiece 201.

Figure 4:
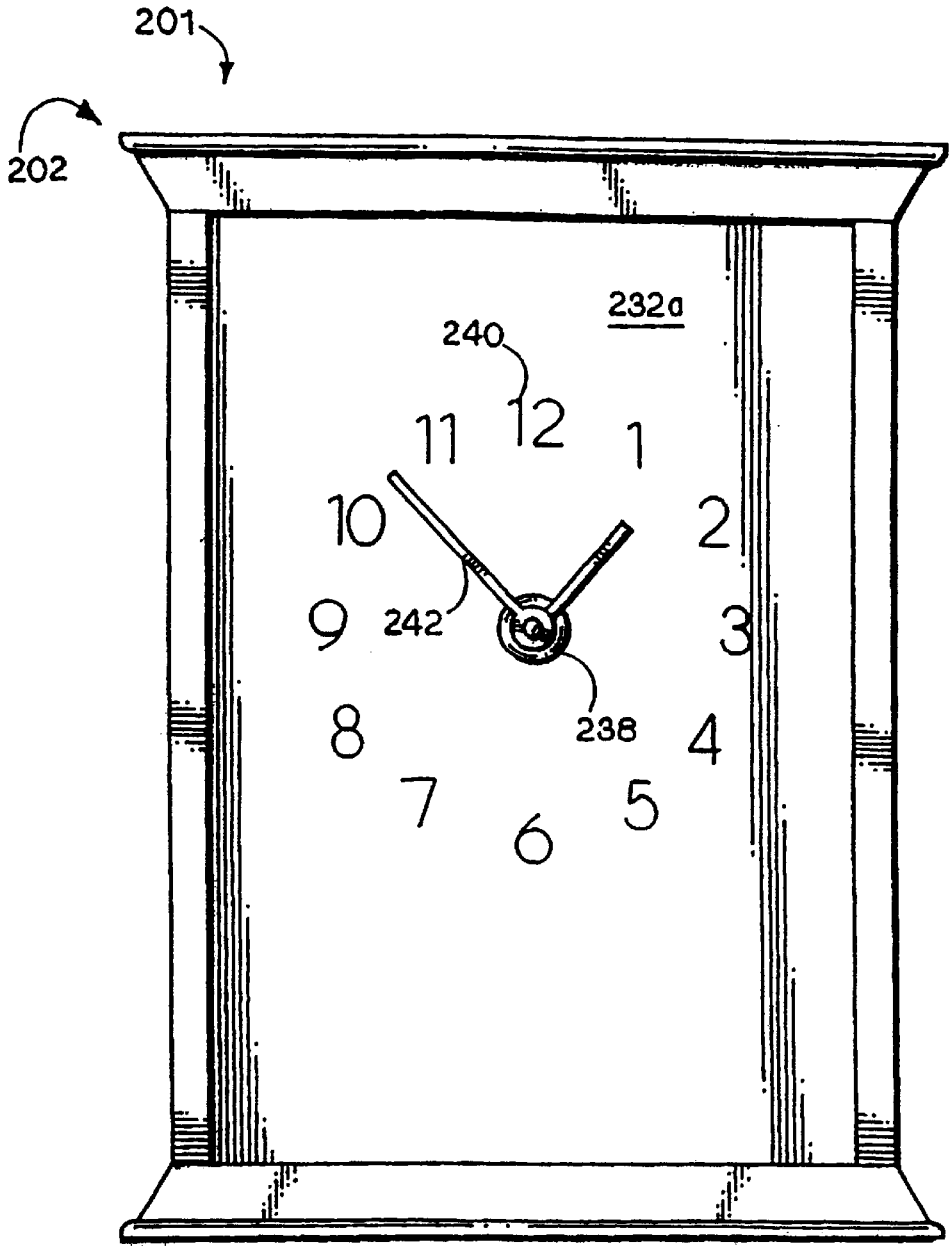
FIG. 4 is a front elevational view of a timepiece comprising a first modified embodiment of the timepiece.

FIG. 4 shows a timepiece 201 comprising a first modified embodiment of the present invention. The timepiece 201 generally comprises a supportive structure 202, a face subassembly 204 and a clock mechanism 206. The supportive structure 202 and the clock mechanism 206 are substantially identical to the supportive structure 2 and the clock mechanism 6 previously described.

The face subassembly 204 differs from the face subassembly 4 previously described. Namely, the face subassembly 204 includes a display 232 with an opening 238 which is smaller than the previously described opening 38. A shaft 239 of the clock mechanism 206 extends through the opening 238. The relatively smaller opening 238 allows the display 232 to have a greater surface area. Markings 240, such as Arabic or Roman numerals, may be made directly on or attached to the display's outer surface 232*a*.

Once again, the display 232 is mounted on a backing 242 and is readily interchangeable. The timepiece 201 assembly and the changing of the display 232 are identical to that previously described in section V. with one exception. Namely, a plurality of hands 242 must be removed before attaching the display 232 to or removing it from the supportive structure 202. The hands 242 can be reattached after the display 232 is coupled with the supportive structure 202.

It is to be understood that while certain forms of the present invention have been illustrated and described herein, it is not to be limited to the specific forms or arrangement of parts described and shown.

What is claimed and desired to be secured by letters patent is as follows:

1. A method of removably mounting multiple timepiece displays to a timepiece backing having a plurality of openings extending through the backing, and having a plurality of connectors attached to one of the display or the backing and a plurality of seats attached to the other of the display or the backing, said method comprising the steps of:

a) positioning said display on top of the backing such that an attaching coupling force is created between the seats and the connectors; and b) applying a detaching force through one of the backing's openings such that the coupling force between the seats and the connectors is broken.

2. A timepiece, which comprises:

(a) a backing having a plurality of openings extending through the backing;

(b) multiple time piece displays;

(c) a plurality of connectors each attached to one of the displays or to the backing;

(d) a plurality of seats each attached to the other of the displays or to the backing;

(e) said multiple timepiece displays being adapted for removable mounting on the backing with the display positioned on top of the backing whereby an attaching coupling force is created between the seats and the connectors; and (f) the displays being removable from the backing by applying a detaching force through one of the backing's openings such that the coupling forces between the seats and the connectors are broken.

* * * * *